US007481011B2

(12) United States Patent
Nesseth

(10) Patent No.: US 7,481,011 B2
(45) Date of Patent: Jan. 27, 2009

(54) DOUBLE WING SCRAPER

(75) Inventor: Clinton Nesseth, Cameron, WI (US)

(73) Assignee: NTH Inc., Barron, WI (US)

( * ) Notice: Subject to any disclaimer, the term of this patent is extended or adjusted under 35 U.S.C. 154(b) by 69 days.

(21) Appl. No.: 11/095,124

(22) Filed: Mar. 30, 2005

(65) Prior Publication Data

US 2005/0229437 A1 Oct. 20, 2005

Related U.S. Application Data

(60) Provisional application No. 60/558,587, filed on Mar. 30, 2004.

(51) Int. Cl.
*E01H 5/06* (2006.01)
*E01H 5/04* (2006.01)

(52) U.S. Cl. ..... 37/281; 37/234; 37/274; 172/815

(58) Field of Classification Search ..... 37/281, 37/282, 283, 241, 232, 234, 266, 269, 279, 37/272, 274; 172/782, 786, 815, 684.5, 816, 172/2

See application file for complete search history.

(56) References Cited

U.S. PATENT DOCUMENTS

| | | | | |
|---|---|---|---|---|
| 2,556,592 | A | 6/1951 | Markkula | |
| 3,250,026 | A | 5/1966 | Jocher et al. | |
| 3,651,587 | A * | 3/1972 | Plasser et al. | 37/105 |
| 3,807,064 | A | 4/1974 | Schmidt, Jr. | |
| 3,961,492 | A | 6/1976 | Buehler et al. | |
| 4,306,362 | A | 12/1981 | Waterman | |
| 4,723,609 | A | 2/1988 | Curtis | |
| 4,779,363 | A | 10/1988 | Boutrais et al. | |
| 5,285,588 | A | 2/1994 | Niemela et al. | |
| 5,411,102 | A | 5/1995 | Nickels et al. | |
| 5,573,071 | A | 11/1996 | Wilson et al. | |
| 5,638,618 | A | 6/1997 | Niemela et al. | |
| 5,819,444 | A * | 10/1998 | Desmarais | 37/281 |
| 5,829,174 | A | 11/1998 | Hadler et al. | |
| 5,848,654 | A | 12/1998 | Belcher, Jr. | |
| 6,035,944 | A * | 3/2000 | Neuner et al. | 172/818 |
| 6,112,438 | A | 9/2000 | Weagley | |
| 6,408,549 | B1 | 6/2002 | Quenzi et al. | |
| 6,412,199 | B1 | 7/2002 | Quenzi et al. | |
| 6,425,196 | B1 * | 7/2002 | Weagley et al. | 37/270 |
| 6,442,877 | B1 * | 9/2002 | Quenzi et al. | 37/281 |
| 6,691,435 | B1 * | 2/2004 | Schultz et al. | 37/234 |

FOREIGN PATENT DOCUMENTS

| | | |
|---|---|---|
| JP | 02311607 | * 12/1990 |

* cited by examiner

*Primary Examiner*—Thomas A Beach
(74) *Attorney, Agent, or Firm*—Merchant & Gould P.C.

(57) ABSTRACT

A blade assembly includes a main body vertical blade portion and a pair of wings pivotally mounted at the ends of the main body. A hydraulic cylinder attached to each wing pivotally moves each wing relative to the main body, the cylinders being operatively connected in series. Each wing is configured to rotate through a range of rotation substantially equal that of the other wing but includes a different radius of rotation than the other wing.

18 Claims, 6 Drawing Sheets

DOUBLE WING SCRAPER

This application is a utility patent application claiming priority to the provisional U.S. patent application Ser. No. 60/558,587 filed on Mar. 30, 2004, which application is incorporated herein by reference.

FIELD OF THE INVENTION

This invention relates generally to material plowing and scraping and more particularly to an improved blade assembly for a vehicle such as a skid steerer, tractor or the like.

BACKGROUND OF THE INVENTION

A wide variety of blade configurations for vehicles such skid steerers, tractors or the like for plowing or scraping material such as snow are available and in use. These include straight bladed plows of the type shown in U.S. Pat. No. 3,250,026, and center-hinged, V-plows of the type shown in U.S. Pat. No. 6,035,944. Other straight bladed plows have been devised with one or both ends being slidably extendable as shown in U.S. Pat. No. 3,807,064. Yet other plows have included straight blades with pivotable, non-extendable ends as shown in U.S. Pat. Nos. 6,425,196, 6,412,199, and 2,556,592. U.S. Pat. No. 5,573,071 shows one plow having permanently forwardly angled plow ends, wherein the entire plow swings from side to side so as to angle the entire plow left or right.

While each of the above types of prior known plows is useful in one or more situations, a blade design flexible enough to be used in a wide variety of different applications has been lacking in the art.

The type of blade configuration that has a variable width has proven to be useful in the art for a number of different reasons. Besides providing the ability to plow and scrape sites of varying sizes such as parking lots or narrower sidewalks, this type of a configuration has facilitated the transport of the vehicles carrying such blades. For example, for vehicle-mounted plows which must be transported from one site to another for clearing snow or other plowable materials, it is necessary that the plow be narrow enough to allow transport on public highways which have limited lane width. However, when actually engaged in plowing, it is very desirable that the plow have an extended width so that larger areas such as parking lots or other sites can be cleared of snow more quickly.

Another type of a blade configuration, one utilizing pivotable ends, has proven useful in preventing spillover of plowable material from the blade edges. In this type of a blade design, it has been considered essential to provide for independent pivotability of each end such that one end can be pivoted in while the other pivoted out for angled plowing operations where the snow is directed to one or the other side.

While many innovative blade configurations have been developed in the art, a design that makes it possible to effectively and easily clean areas such as the edge of a wall or a dead end alleyway by pulling a charge of material backwards from a confined area has been lacking.

What is needed in the art is a blade configuration flexible enough to combine all the known useful features of the current plow designs with the ability to plow materials from sites such as dead end alleyways. Such needs include a short enough plow length to allow transportation on public highways, a long enough length for fast, efficient clearing of a large job site, means to carry or push plowable material from one area to another without letting the plowed material slip off the plow ends, at the same time allowing for angled plowing, and the ability to effectively clean all the way up to walls and sites such as dead end alleyways. All of these needs should be met while minimizing the cost, size, and space required for the plow in each of its arrangements.

The present invention addresses the described deficiencies of prior art blade configurations for material plowing and scraping by providing a relatively simple, reliable, and cost effective blade assembly flexible enough to be used for a wide variety of applications.

SUMMARY OF THE INVENTION

The invention provides an improved blade assembly to be mounted to a vehicle such as a skid steerer, tractor or the like which includes a scraper of variable width which can be used to scrape snow from parking lots or driveways, manure from barn alleyways, grain from large storage floors or any other material which must be moved horizontally to another location. The invention incorporates a blade with two hydraulically operated pivotable wings which allows the operator to change the width of the unit to varying sizes needed for a particular job. The pivotable wings are operated via hydraulic cylinders arranged in series. Each wing includes an equal range of rotation to the other wing but includes a different radius of rotation than the other wing to compensate for the cylinders being hydraulically activated by a single series circuit.

BRIEF DESCRIPTION OF THE DRAWINGS

Referring now to the Drawings, wherein like numerals represent like parts throughout the several views.

DETAILED DESCRIPTION OF THE PREFERRED EMBODIMENT

Figure 1:
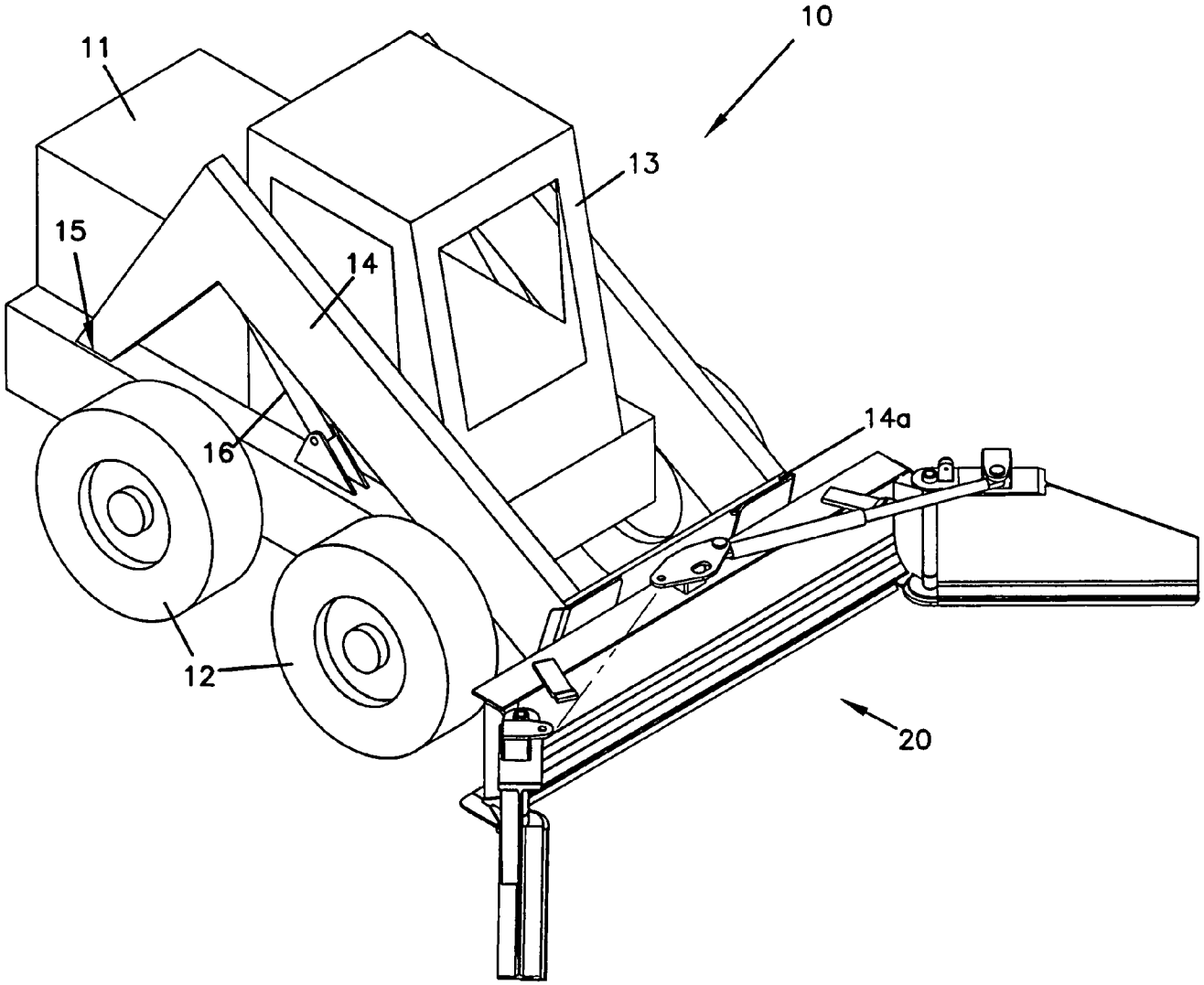
FIG. 1 is a perspective view of a skid steerable vehicle to which is mounted a blade assembly incorporating the principles of the invention.

Referring to FIGS. 1-7, there is generally illustrated therein a preferred embodiment of a blade assembly that incorporates the principles of this invention. In FIG. 1, the blade assembly is illustrated as attached to and being movable by a skid steerable vehicle 10. It will be understood that the invention is not limited to use with a skid steerable vehicle illustrated in FIG. 1, but that the skid steerable vehicle is simply representative of one embodiment of a vehicle that can be used to practice the principles of this invention.

Referring to FIG. 1, the skid steerable vehicle 10 generally includes a chassis 11 containing an engine and power train for moving and operating the vehicle. The vehicle includes a plurality of wheels, generally indicated at 12, for moving the vehicle over the ground or support surface. In a skid steerable vehicle, the vehicle turns by locking one or more of the wheels while powering the others in a manner well known in the art. The vehicle 10 typically has a cab portion 13 wherein an operator sits to control the vehicle, and a primary pair of pivotably movable lift arms 14 that can be raised and lowered about their rear pivot positions, generally indicated at 15 to raise and lower the forward ends 14*a* of the operator arms 14 relative to the ground or support surface. A pair of hydraulic lift cylinders 16 provide the motive force for rotatably moving the operator arms 14. The skid steerable vehicle 10 also has a universal mounting bracket assembly well known in the art (not illustrated in the Figs.) pivotably connected to the forward ends 14*a* of the operator arms 14 which provides detachable mounting and connection to various implements such as the blade assembly of the present invention generally indicated at 20. Other implements such as bucket assemblies, fork lift members, and the like can be detachably secured to the universal mounting bracket assembly in manners well known in the art. The mounting bracket is movable and pivotable relative to the forward ends 14*a* of the operator arms 14 by one or more hydraulic cylinders (not illustrated) to pivotally move the mounting bracket and attached implements relative to the forward ends 14*a* of the operator arms 14.

Since configurations and operations of such skid steerable vehicles are well known in the art, further details thereof will not be provided herein, it being understood that those skilled in the art clearly understand the nature of such vehicles and how they operate in numerous versatile situations. Skid steerable vehicles such as that generally illustrated at 10 typically include one or more auxiliary pairs of hydraulically operated and controllable lines powered by the vehicle and extending forwardly therefrom for providing sources of hydraulic power that can be controlled by the operator within the vehicle to energize hydraulic motors, cylinders and the like carried by the implement attached to the vehicle such as the blade assembly 20 of the present invention, or for other desired purposes. For simplicity in illustrating the invention and for clarity in the figures, such hydraulic lines are not illustrated in the Drawings, but are understood to exist and to extend from and between the vehicle to the various hydraulic devices to be hereinafter described, for effecting proper operation thereof. An example of such a hydraulic circuit as used to energize the hydraulic portions of the present invention will be described in more detail with respect to FIG. 6.

A more detailed description of the blade assembly 20 of the present invention is illustrated in FIGS. 2-5, and 7. Referring thereto, the blade assembly 20 includes two wings 22 and a main body 24 interposed in between and connecting the wings 22.

Figure 2:
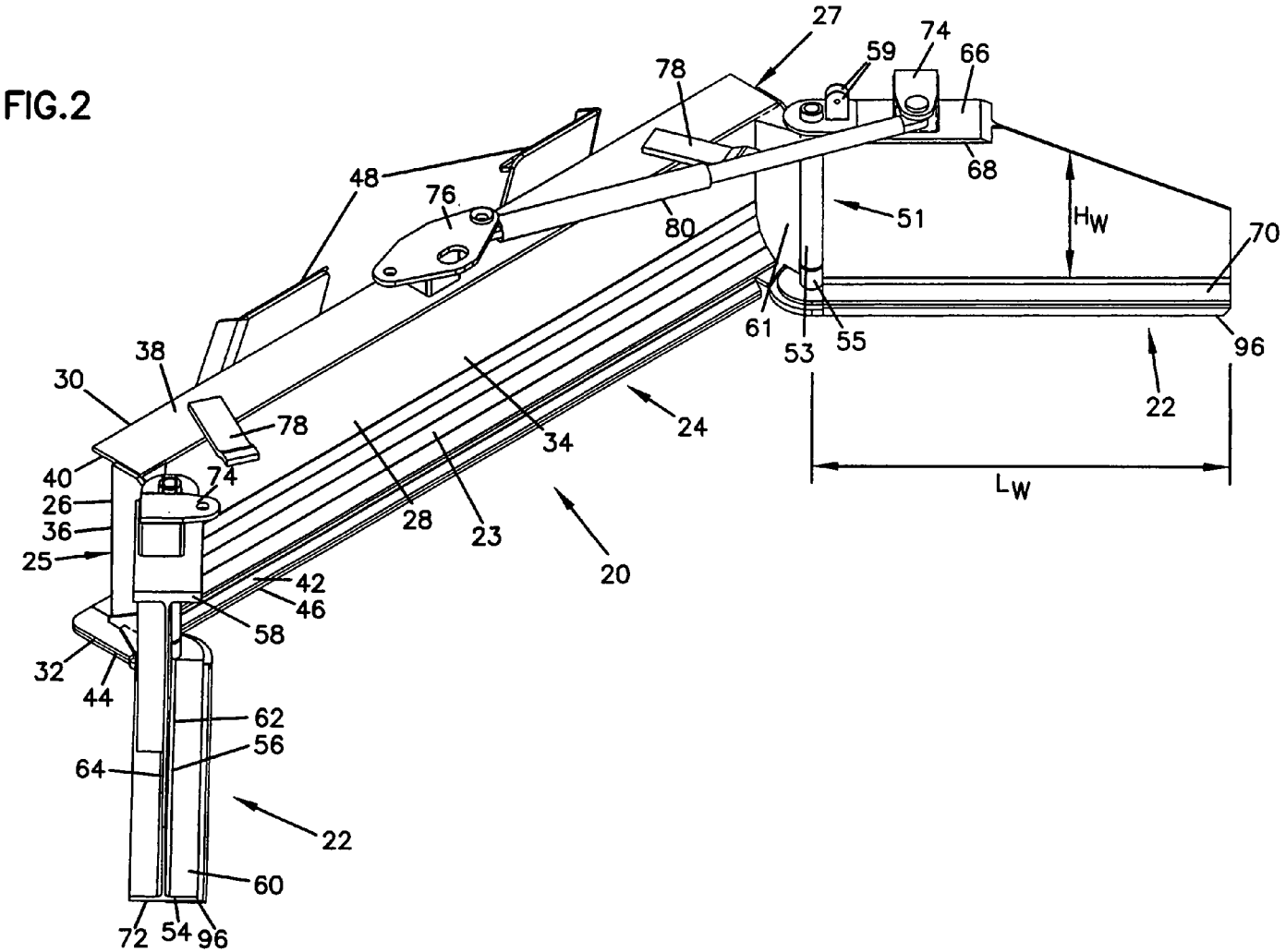
FIG. 2 is a left perspective view of the blade assembly of FIG. 1.
Figure 3:
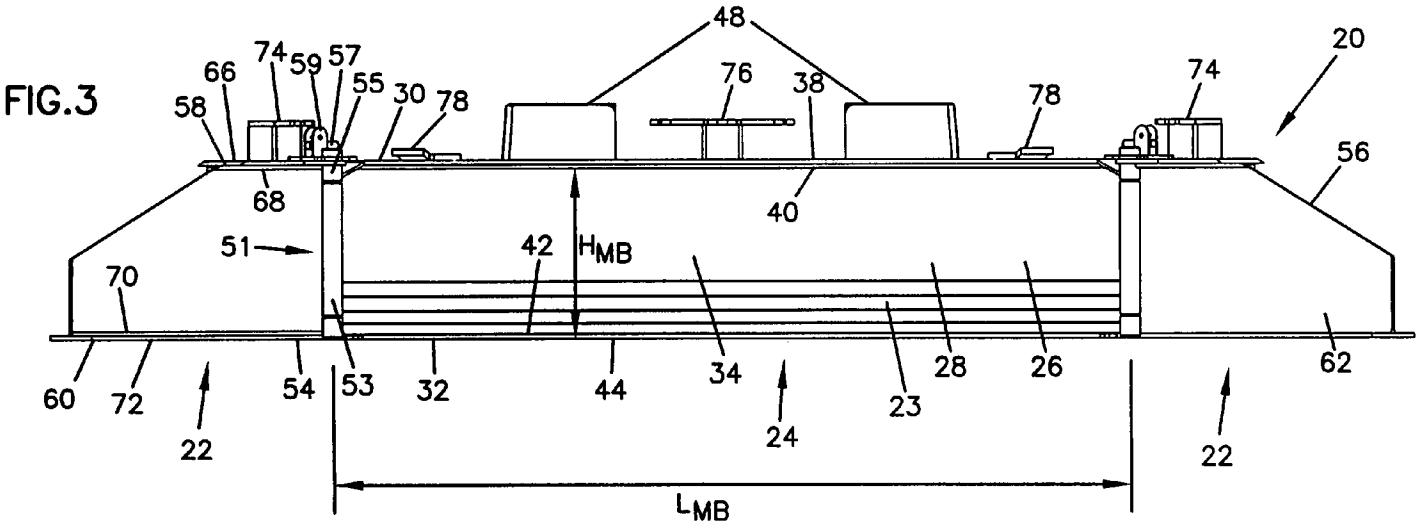
FIG. 3 is a front view of the blade assembly of FIGS. 1 and 2.
Figure 4:
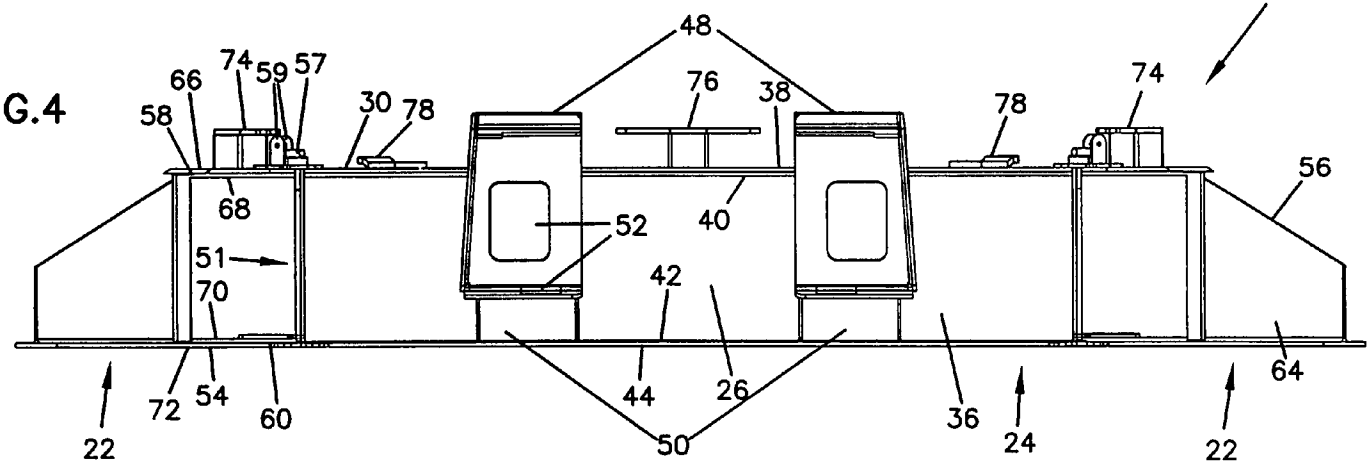
FIG. 4 is a back view of the blade assembly of FIGS. 1-3.
Figure 5:
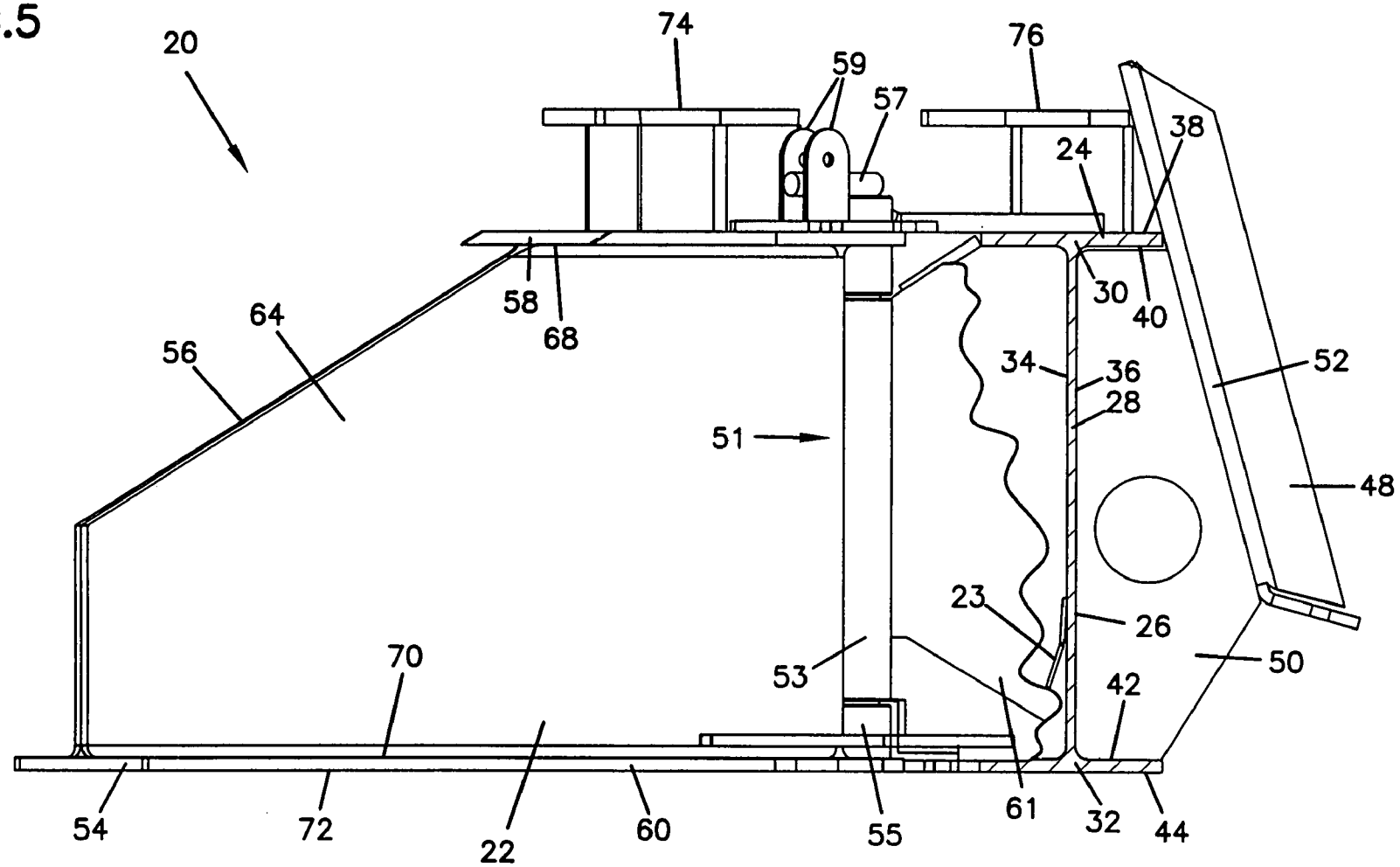
FIG. 5 is a right side view of the blade assembly of FIGS. 1-4 with portions thereof broken away, illustrating the I-beam structure of the main body of the blade assembly with cross-hatching and illustrating the hinge plate with a break therein to further emphasize the I-beam structure of the main body.

The main body 24 of the blade assembly includes a left end 25 and a right end 27. The shape of the main body 24, including the length $L_{MB}$ and the height $H_{MB}$, as illustrated in FIG. 3, can vary depending on the application for which the blade assembly 20 is used. In the preferred embodiment of the blade assembly illustrated, the main body 24 of the blade assembly 20, as can be seen in FIGS. 1-5 and 7, includes an elongate steel construction with an I-beam cross-section 26. The I-beam construction 26 is best illustrated in FIG. 5, where it is illustrated with cross-hatching. In FIG. 5, the hinge plate 61 is shown with a break therein to further emphasize the I-beam structure of the main body. It will be understood that the I-beam construction 26 of the main body 24 is a preferred cross-sectional shape, and the main body 24 can be constructed to be of any other cross-sectional shape and of any type of metal.

The I-beam construction 26 is essentially formed by welding a vertical plate 28 in between two spaced apart horizontal plates, the top plate 30 and the bottom plate 32. The vertical plate 28 defines a front face 34 and a rear face 36. The top horizontal plate 30 defines a top surface 38 and a bottom surface 40. Likewise, the bottom horizontal plate 32 defines a top surface 42 and a bottom surface 44. The bottom surface 44 of I-beam 26 essentially provides a wide, flat scraping surface that moves parallel to and along the ground. An elongate flat scraping surface can glide well over hard ground surfaces without damaging the ground surfaces. The I-beam construction 26 also defines essentially symmetrical U-shaped cross sections at both the front and rear of the main body 24. This construction helps scoop and keep snow or other plowable material on the faces of the main body 24 regardless of whether the blade assembly 20 is moving in the forward or in the backward direction. As illustrated in FIGS. 2-4 and 5, a deflection plate, indicated at 23 can be welded between the front face 34 and the top surface 42 of the bottom horizontal plate 32. The deflection plate 23 is generally used to deflect snow or other plowable materials upwards to prevent pile up of material adjacent the bottom part of the blade.

The I-beam structure minimizes fabrication operations, time, and cost over other conventional plows. It also eliminates the need for wear shoes, such as those attached to edges of the conventional blades, since the entire lower plate 32 acts as a large elongate wear shoe. In the preferred embodiment of the blade assembly illustrated, a reinforcing grader blade shoe 46 may be attached to the bottom surface 44 of the bottom horizontal plate 32 to improve the wear factor for the plate 32, as seen in FIG. 2. Such a grader blade shoe 46 may be constructed of any rubber or other available compounds in the art suited for its purpose.

Referring to FIGS. 1-5 and 7, a pair of standard quick hitch mounting plates, generally indicated at 48, are used to couple the blade assembly 20 to a vehicle such as a skid steerer. The hitch mounting plates 48 are welded to the rear face 36 of the vertical plate 28 by means of a pair of support plates 50 for each hitch mounting plate 48, best illustrated in FIGS. 4 and 5. Referring thereto, the hitch mounting plates 48 include a plurality of engagement apertures, generally indicated at 52, which cooperatively engage the universal mounting bracket arms of the skid steerable vehicle, in a manner well known in the art, for enabling detachable secured movement of the blade assembly by the movable operator arms of the vehicle 10. It will be understood that other types of standard quick hitch mounting designs or other attachment mechanisms may be used within the spirit of the invention to attach the blade assembly to a movable vehicle.

The wings 22 of the blade assembly 20, as illustrated in FIGS. 1-5 and 7 are pivotally attached to the main body 24 adjacent its ends 25, 27. Except for slight differences which will be hereinafter described, the structures of the right and the left wing are virtually identical. Therefore, any discussion relating to one wing will be understood to be applicable to the other.

The shape of each of the wings 22, including the length $L_W$ and the height $H_W$, as illustrated in FIG. 2, can vary depending on the application for which the blade assembly 20 is used. The height $H_W$ of the wing 22 does not have to be uniform along its length $L_W$ and can vary depending on the application. In the preferred embodiment of the wing 22, the wing 22 has a height $H_W$ that decreases toward the end of the wing. The lengths $L_W$ of the wings 22 along with the length $L_{MB}$ of the main body 24 allows an operator of the vehicle to change the operable width of the blade assembly 20 according to the desired application of the blade assembly. Preferably, the operable width of the entire blade assembly 20 has a range from about 4 feet to 30 feet. More preferably, the operable width of the blade assembly 20 has a range from about 5 feet to 20 feet. Most preferably, the operable width of the blade assembly 20 has a range from about 6 feet to 13 feet. The wings 22 and the main body 24 can be sized to form a complete triangular enclosure by pivotally rotating the wings toward one another if desired.

In the preferred embodiment of the blade assembly illustrated, the wings 22 are also of I-beam construction 54, similar to that of the main body 24, for similar reasons. Each wing includes a vertical plate 56 in between two spaced apart horizontal plates, the top plate 58 and the bottom plate 60. The vertical plate 56 defines an inner face 62 and an outer face 64. The top horizontal plate 58 defines a top surface 66 and a bottom surface 68. Likewise, the bottom horizontal plate 60 defines a top surface 70 and a bottom surface 72. As illustrated in FIG. 2, a reinforcing grader blade shoe 96 such as one used for the main body may also be attached to the bottom surface 72 of the bottom horizontal plate 60 to improve the wear factor for the plate 60.

Each wing 22 is coupled to the main body 24 via a hinge assembly 51. The hinge assembly 51 is essentially made up of two intermating halves held together by an L-shaped hinge pin 57. One half 53 of the hinge assembly 51 is attached to the main body 24 by means of a hinge plate 61 welded to the front face 34 of the main body 24.

The other half 55 of the hinge assembly 51 is integrally welded to the wing 22. The two halves 53 and 55 of the hinge assembly 51 are pivotally coupled to each other and held together by the removable L-shaped hinge pin, indicated at 57. As best illustrated in FIGS. 3-5 and 7, the hinge pin 57 is locked in place in between a pair of pin plates 59 extending from the top surface 66 of each wing 22. By removing the hinge pin 57, each wing 22 can be uncoupled from the main body 24 if needed. Although the hinge assembly 51 has been described in substantial detail, it will be understood that other types of pivotal connection structures may be employed to attach the wings 22 to the main body 24.

As illustrated, the main body 24 may include a pair of stopper plates 78 mounted to the top surface 38 of the top horizontal plate 30. Structures such as the stopper plates 78 or other structures may be used to prevent the wings 22 from swinging inwardly beyond a certain point.

Each wing 22 is made pivotably operable via one or more double acting hydraulic cylinders, generally indicated at 80. The hydraulic cylinders are illustrated only in FIGS. 1, 2 and 7 as being attached to one of the wings 22 for descriptive purposes and have been left out of other figures for clarity purposes. In the preferred embodiment, each wing 22 includes a cylinder bracket 74 mounted on the top surface 66 of the top horizontal plate 58. The main body 24 includes a cylinder bracket 76 mounted to the top surface 38 of the top horizontal plate 30 for attaching two cylinders 80. The hydraulic cylinders 80 extend between the wing cylinder brackets 74 and the main body cylinder bracket 76. Depending on the sizes of the structural components of the blade assembly 20 and the sizes of the cylinders 80 used, each wing 22 may have a swing range from between about 90 degrees to 150 degrees.

Figure 7:
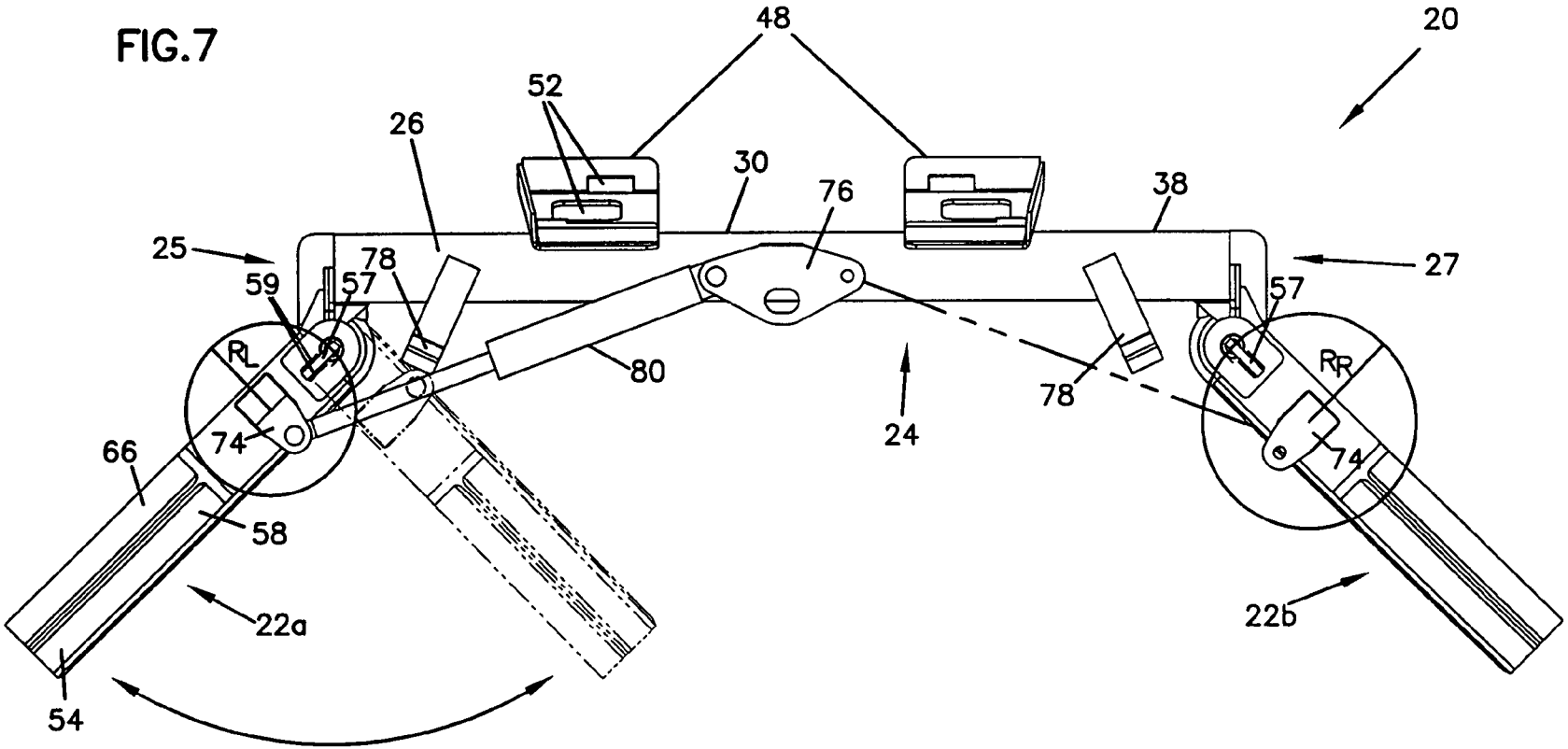
FIG. 7 is a top view of the blade assembly of FIGS. 1-6, illustrating the pivotability and the swing radius for each wing.

Each wing 22 can be configured to be pivotably operable independently of the other wing. Thus, each wing 22 can be in a closed or open position at a point in time regardless of the position of the other wing. In FIG. 2, each wing 22 is illustrated in an open position. The pivotability of the wings 22 is illustrated in FIG. 7. The swing path of the left wing 22*a* is illustrated by the arrows, and the closed position of the left wing 22*a* is illustrated by the ghost lines.

The hydraulic cylinders 80 for pivoting the wings 22 can be arranged in parallel or in series. In the preferred embodiment of the blade assembly illustrated, the hydraulic cylinders 80 are arranged in series. Arranging the two cylinders 80 in series allows control with a single circuit, eliminating the need for a second control circuit in the form of valves or a proportional divider, making the blade assembly more cost-effective.

Figure 6:
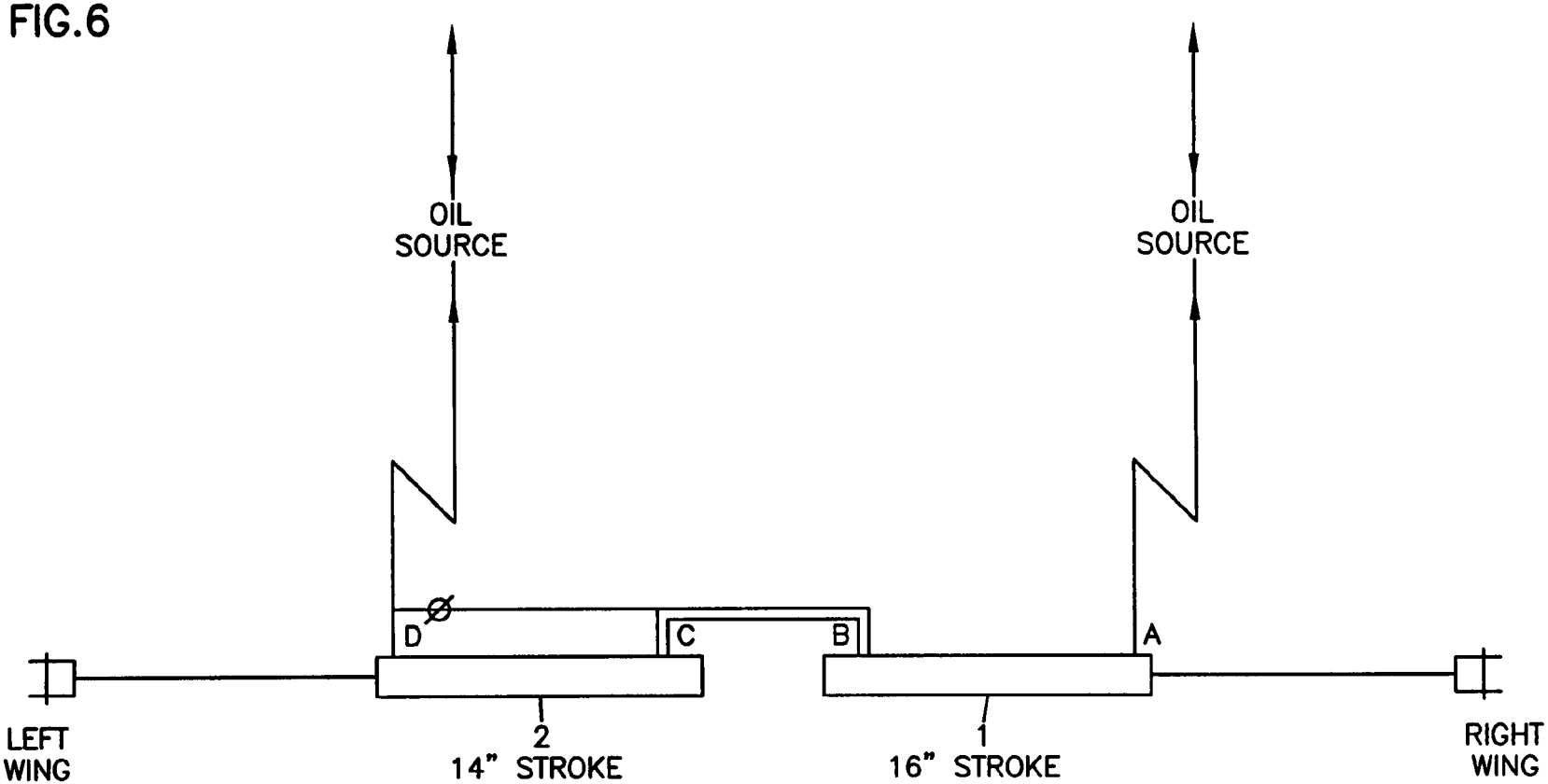
FIG. 6 is a schematic diagram of a hydraulic circuit for operating the wings of the blade assembly with a skid steerable vehicle such as in FIG. 1.

A hydraulic system using a series circuit is schematically illustrated in FIG. 6. In the system shown in FIG. 6, the hydraulic cylinders 80 are energized by means of the auxiliary hydraulic output lines available from the skid steerer vehicle. In the system illustrated in FIG. 6, the oil being forced out of cylinder 1 at point B goes to point C to activate cylinder 2. However, the volume of oil going to point C will not be equal to what was forced into cylinder I at point A. The diminished oil flow to cylinder 2 at point C results from the subtraction of the volume of the ram in cylinder 1. For example, in a 2.5"×16" cylinder, the volume of the ram is equivalent to about 2 inches of stroke with a 16" cylinder. Thus, if cylinder 1 has a full stroke of 16 inches, cylinder 2 will have a full stroke of about 14 inches.

Therefore, if the hydraulic cylinders are arranged in series, the wing activated by the second cylinder in the series needs to have a shorter swing radius to have an equalized swing angle range with that of the other wing. This difference in the swing radii of the two cylinders is illustrated in FIG. 7. The cylinder bracket 74 on the left wing 22*a* is positioned closer to the hinge pivot point than the cylinder bracket on the right wing 22*b* to equalize the swing angle ranges. In this manner, both wings will be able to pivot throughout identical swing ranges and will be able to go from a fully open position to a fully closed position. In FIG. 7, the swing radius of the left wing 22*a* is depicted at $R_L$ and the swing radius of the right wing is depicted at $R_R$. It will be understood that the difference in swing radii will vary in different blade assemblies depending upon the size of the cylinders used.

Referring back to FIG. 6, a by-pass circuit, well known in the art, indicated by the line going from point B to point D, can be utilized to make start-up easier and allow for retiming of the two cylinders if any oil loss should occur internally within either cylinder. The by-pass circuit makes it possible to get the oil into the hose between the two cylinders. Unless needed, this by-pass circuit is normally closed One way in which the blade assembly can be used is as follows. In operation, a skid steerer or the like is driven up toward a dead-end wall of a site such as a barn alleyway from which debris is to be removed with the blade assembly 20 in a raised position. The operator of the skid steerer then drops the blade assembly 20 down in operative position with the wings 22 in an open position, extended all the way to the side edges of the alleyway. The forward edges of the blade is positioned at a distance from the wall about equal to the swing radius of the wings. The operator of the vehicle then pivots the wings 22 inwardly to scoop, for example, the refuse from along the edge of the wall and pulls it back from the end wall, containing the refuse between the three portions of the blade assembly 20: the two wings 22 and the main body 24. The skid steerer can then be backed up to clean a swath of the alleyway extending out from the wall and down the alleyway. The blade assembly 20 is then lifted, and the skid steerer is driven into the cleaned area. The skid steerer is then pivoted around 180°, at which point the blade assembly 20 is dropped down and expanded to the width of the alleyway. The alleyway is then scooped clean in normal plowing fashion with the refuse being pushed by the blade assembly 20. The outer-wings can be pivoted forward to contain the removed debris between the main body and the two outer wings.

The blade assembly can also be used for normal plowing to provide a variable width plow, such as for scraping snow from parking lots, driveways or the like.

It will be appreciated that while a preferred embodiment, description and application of the invention has been disclosed, other modifications of the invention not specifically disclosed or referred to herein will be apparent to those skilled in the art in light of the foregoing description. This invention is intended to provide a specific example of a preferred embodiment structure and application which clearly discloses the apparatus and method of the present invention and its operative principles. Accordingly, the invention is not limited to any particular embodiment or configuration or component parts thereof or to the used of any particular materials for their construction. All alternatives, modifications, and variations of the present invention which fall within the spirit and broad scope of the appended claims are covered.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A blade assembly comprising:

(a) a main body including a first end, a second end, and a generally vertical blade portion;

(b) a first wing operatively pivotally mounted adjacent the first end and a second wing operatively pivotally mounted adjacent the second end of the main body;

(c) a first hydraulic cylinder operatively connecting the first wing to the main body and a second hydraulic cylinder operatively connecting the second wing to the main body, the first hydraulic cylinder extending from the main body to a first cylinder mounting location on the first wing, the second hydraulic cylinder extending from the main body to a second cylinder mounting location on the second wing, the first and second cylinders constructed for pivotally moving said wings relative to said main body, said cylinders being operatively connected in a series-type hydraulic circuit;

(d) wherein the distance from the first end of the main body, where the first wing is pivotally mounted, to the first cylinder mounting location defining a first swing radius is longer than the distance from the second end of the main body, where the second wing is pivotally mounted, to the second cylinder mounting location defining a second swing radius, wherein each wing is configured to rotate through a range of rotation substantially equal that of the other wing, wherein the difference in the first and second swing radii provides varying rates of rotation between the first and second wings to compensate for fluid loss between the cylinders in the series-type hydraulic circuit.

2. A blade assembly according to claim 1, wherein the main body generally comprises an I-beam construction.

3. A blade assembly according to claim 1, wherein the wings generally comprise an I-beam construction.

4. A blade assembly according to claim 1, wherein the main body is configured for detachable attachment to a vehicle.

5. A blade assembly according to claim 1, wherein the main body includes a hitch mounting plate.

6. A blade assembly according to claim 1, wherein the range of rotation is between about 90 and 150 degrees.

7. A blade assembly according to claim 1, wherein the hydraulic circuit for the wings includes a by-pass circuit.

8. A blade assembly according to claim 1, wherein each wing is configured to be removable from the main body.

9. A blade assembly according to claim 1, wherein said wings cooperatively pivotally move together and complimentarily with respect to each other between an open position and a closed position.

10. A blade assembly according to claim 1, wherein a lower surface of the main body comprises a wide elongate flat portion extending between said first and said second ends and lying generally perpendicular to the blade portion.

11. A vehicle comprising:

(a) a blade assembly including:

(i) a main body including a first end, a second end, and a generally vertical blade portion;

(ii) a first wing operatively pivotally mounted adjacent the first end and a second wing operatively pivotally mounted adjacent the second end of the main body;

(iii) a first hydraulic cylinder operatively connecting the first wing to the main body and a second hydraulic cylinder operatively connecting the second wing to the main body, the first hydraulic cylinder extending from the main body to a first cylinder mounting location on the first wing, the second hydraulic cylinder extending from the main body to a second cylinder mounting location on the second wing, the first and second cylinders constructed for pivotally moving said wings relative to said main body, said cylinders being operatively connected in a series-type hydraulic circuit;

(iv) wherein the distance from the first end of the main body, where the first wing is pivotally mounted, to the first cylinder mounting location defining a first swing radius is longer than the distance from the second end of the main body, where the second wing is pivotally mounted, to the second cylinder mounting location defining a second swing radius, wherein each wing is configured to rotate through a range of rotation substantially equal that of the other wing, wherein the difference in the first and second swing radii provides varying rates of rotation between the first and second wings to compensate for fluid lose between the cylinders in the series-type hydraulic circuit.

12. A vehicle according to claim 11, wherein the vehicle includes a cab portion, a plurality of wheels, a pair of movable lift arms, and hydraulic lift cylinders for moving the lift arms, wherein the blade assembly is attached to the movable lift arms.

13. A vehicle according to claim 12, wherein the vehicle includes a skid steerable vehicle.

14. A vehicle according to claim 11, wherein the blade assembly is configured for detachable attachment to the vehicle.

15. A vehicle according to claim 11, wherein the hydraulic circuit for moving the wings is energized by the vehicle.

16. A method of using a blade assembly, the method comprising the steps of:

(a) providing a vehicle including a hydraulic oil source;

(b) attaching a blade assembly to the vehicle, the blade assembly including a main body with a first end, a second end, and a generally vertical blade portion, the blade assembly also including a first wing operatively pivotally mounted adjacent the first end and a second wing operatively pivotally mounted adjacent the second end of the main body, wherein a first hydraulic cylinder operatively connects the first wing to the main body and a second hydraulic cylinder operatively connects the second wing to the main body, the first hydraulic cylinder extending from the main body to a first cylinder mounting location on the first wing, the second hydraulic cylinder extending from the main body to a second cylinder mounting location on the second wing, wherein the distance from the first end of the main body, where the first wing is pivotally mounted, to the first cylinder mounting location defining a first swing radius is longer than the distance from the second end of the main body, where the second wing is pivotally mounted, to the second cylinder mounting location defining a second swing radius, the first and second cylinders being operatively arranged in a series-type hydraulic circuit; and (c) energizing said hydraulic cylinders with said hydraulic oil source, such that each wing can be rotated through a range of rotation substantially equal that of the other wing, wherein the difference in the first and second swing radii provides varying rates of rotation between the first and second wings to compensate for fluid loss between the cylinders in the series-type hydraulic circuit.

17. A method according to claim 16, wherein the blade assembly is detachably attached to the vehicle.

18. A method according to claim 16, wherein the vehicle includes a skid-steerable vehicle.

* * * * *